United States Patent [19]

Mizelle

[11] 4,437,701

[45] Mar. 20, 1984

[54] ROCKER-BLOCKING DEVICE FOR ROCKING CHAIR HAVING PROJECTABLE/RECTRACTABLE FOOTREST

[75] Inventor: Ned W. Mizelle, High Point, N.C.

[73] Assignee: The Lane Company, Altavista, Va.

[21] Appl. No.: 310,727

[22] Filed: Oct. 13, 1981

[51] Int. Cl.[3] ..... A47C 1/02

[52] U.S. Cl. ..... 297/85; 297/68; 297/83; 297/88; 297/269; 297/270; 297/DIG. 7

[58] Field of Search ..... 297/270, 85, 269, 261, 297/88, 68, 83, 84, DIG. 7

[56] References Cited

U.S. PATENT DOCUMENTS

| | | | |
|---|---|---|---|
| 2,746,519 | 5/1956 | Krikoriah | 297/DIG. 7 |
| 2,776,702 | 1/1957 | Belisle . | |
| 2,776,703 | 1/1957 | Belisle . | |
| 2,907,323 | 10/1959 | Katz . | |
| 3,163,464 | 12/1964 | Martin et al. | 297/DIG. 7 |
| 3,302,969 | 2/1967 | Mizelle | 297/DIG. 7 |
| 3,339,972 | 9/1967 | Fletcher | 297/DIG. 7 |
| 3,352,601 | 11/1967 | Cycowicz | 297/85 |
| 3,747,973 | 7/1973 | Re' | 297/85 |
| 3,867,170 | 3/1975 | James et al. | 297/270 |
| 3,902,735 | 4/1974 | Re' | 297/84 |

FOREIGN PATENT DOCUMENTS

| | | | |
|---|---|---|---|
| 1427591 | 3/1976 | United Kingdom | 297/DIG. 7 |

*Primary Examiner*—James T. McCall

*Attorney, Agent, or Firm*—Cushman, Darby and Cushman

[57] ABSTRACT

The present invention provides a rocker-blocking mechanism for a platform rocking chair which when activated, typically in conjunction with thrusting of a legrest which lifts the user's feet away from the reassurance of floor contact. The rocker-blocking mechanism includes a forwardly presented, vertically elongated slot mounted in a medially disposed linkage between the chair rocker cam unit and legrest operating mechanism. A rearwardly presented, forward-to-rear tapering wedge element is disposed through the slot, in a linkage between the chair base and the chair rocker cam unit. When the legrest is in a retracted condition, the wedge is so located that there is plenty of space above and below the wedge within the slot to permit free rocking. As the legrest is thrust, the slot is quickly moved relatively forwards along the wedge to a position where the wedge vertically fills the slot, thus blocking rocking. By preference, the upper and lower edges of the slot are provided by rollers made of lubricous plastic material.

31 Claims, 7 Drawing Figures

20
18
10
24
26
28
58
66
14
38
34
16
36
42
22
30
40
12
32

ROCKER-BLOCKING DEVICE FOR ROCKING CHAIR HAVING PROJECTABLE/RECTRACTABLE FOOTREST

BACKGROUND OF THE INVENTION

Although the present invention would find ready use on all types of motion chairs, such as reclining chairs and swivelable reclining chairs, in its simplist form the invention relates to rocking chairs which have a legrest (or footrest), which when projected from a stowed condition supports the user's legs in a feet-off-the-floor disposition.

As is well-known, when sitting in a rocking chair, most people apply cyclic foot pressure to the floor while cyclically flexing their leg muscles to bend at the ankle, knee and hip joints in order to rock. But when the rocking chair has a projectable legrest or footrest, and the user projects it, thus sweeping their feet up off the floor, something must be done to block the rockability of the chair. Otherwise, many the user will experience a distinctly uncomfortable out-of-control feeling: he or she no longer can regulate rocking by applying cyclic foot pressure to the floor and minor shifts in the user's position on the chair may set up an uncontrolled extreme-to-opposite-extreme tilting motion which would readily be perceived by many as signalling that the chair is about to tip over.

In order to avoid the possibility of giving the chair user such an untoward experience, motion chair manufacturers have devised diverse ways and means for preventing their chairs from rocking once the user's feet are off the floor. Some of these work quite well on one model or type of chair, but are not useful on others; some are not durable, or require undue precision in manufacture and installation, more than is feasible in a mass manufacture situation.

SUMMARY OF THE INVENTION

The present invention provides a rocker-blocking mechanism for a platform rocking chair which is activated, typically in conjunction with thrusting of a legrest which lifts the user's feet away from the reassurance of floor contact. The rocker-blocking mechanism includes a forwardly presented, vertically elongated slot mounted in a medially disposed linkage between the chair rocker cam unit and legrest operating mechanism. A rearwardly presented, forward-to-rear tapering wedge element is disposed through the slot, in a linkage between the chair base and the chair rocker cam unit. When the legrest is in a retracted condition, the wedge is so located that there is plenty of space above and below the wedge within the slot to permit free rocking. As the legrest is thrust, the slot is quickly moved relatively forwards along the wedge to a position where the wedge vertically fills the slot, thus blocking rocking. By preference, the upper and lower edges of the slot are provided by rollers made of lubricous plastic material.

For the sake of convenience, in the description provided herein, the terms "left" and "right" will be used to refer to the respective lateral directions from the perspective of a person who is sitting in the chair (and not from the perspective of a person who is standing, facing the front of the chair).

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
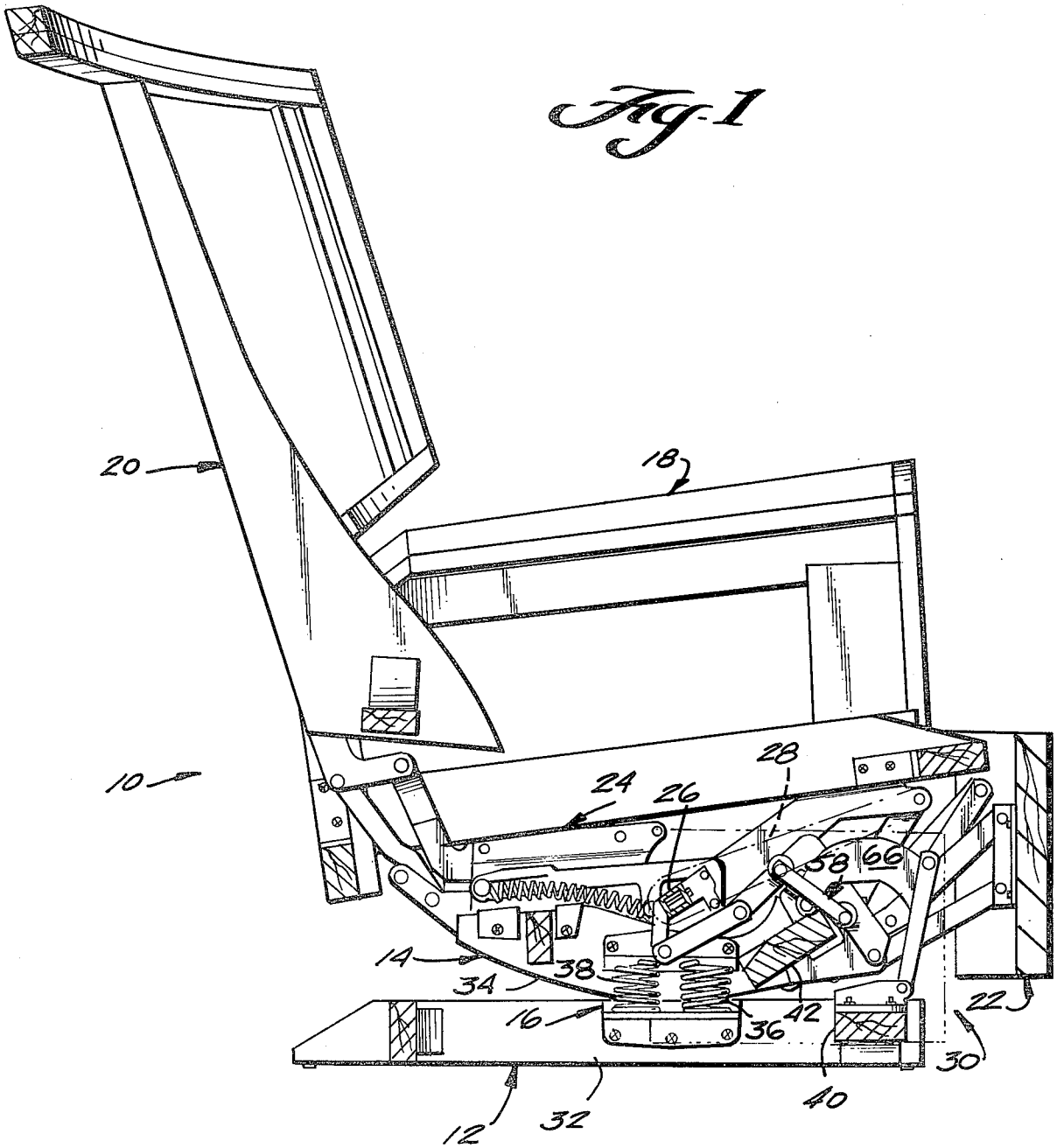
FIG. 1 is a longitudinal vertical sectional view of a chair provided with the apparatus of the invention. This view shows the legrest in a fully retracted condition, so that the rocker-blocking mechanism is in a rock-permitting status. This view is taken on a plane somewhat to the right of a medial plane. Its location is indicated by the line 1—1 in FIG. 3. In this view, as in the others, the chair is shown in a totally not-upholstered condition, the conventional springs, padding, cushioning and upholstery being simply omitted in order to avoid presentation of merely confusing details. The location of the handle for the legrest is suggested in phantom lines, the element itself being too far to the right on the actual chair, to be seen in this figure.

A rocking chair 10 is shown in FIG. 1. Typically this chair includes a base 12, a rocker cam unit 14, identical left and right rocker datum-tending spring units 16 (only the left one of which is shown), a seat and arm frame assembly 18, a backrest frame 20, a legrest 22, and a mechanism 24 which mounts the seat and arm frame assembly 18, the backrest frame 20 and the legrest 22 to the rocker cam unit 14. The mechanism 24 includes generally mirror image left and right portions, only the left one of which is illustrated. These portions are laterally interconnected by being mounted to respective left and right marginal sites on the elements 18, 20 and 22, and by a horizontally-extending torque bar or tube 26, which is journalled for rotation about its own longitudinal axis in respective links of the left and right portions of the mechanism 24. An operating handle 28 is shown fixed on the right end of the torque bar 26. It is by using the handle 28, crank fashion, that the torque bar 26 is rotated clockwise and counterclockwise to project and retract the legrest 22.

(In practice, the mechanism 24 may be constructed so that as the handle 28 is rotated forwards or backwards not only is the legrest projected and retracted, but also the backrest frame 20 is reclined and elevated with respect to the seat and arm frame assembly 18, and/or the backrest frame 20 and the seat and arm frame assembly 18 are tilted back and tilted forwards more or less as a unit. However, because the device of the invention can be used with mechanisms 24 of many of these well-known types, and because there is nothing that needs to be new about a conventional mechanism 24 in order to successfully graft the device of the invention onto the chair, the constructional and operational details of the mechanism 24 are not shown or explained in greater detail herein.)

The rocker-blocking mechanism of the invention is generally designated in the drawing figures by the numeral 30.

In the chair embodiment shown, the base 12 includes side rails 32 on which the cam-shaped rockers 34 of the rocker cam unit 14 are supported for rocking back and forwards. The spring units 16 each include a front spring 36 which is resiliently compressed as the rocker cam unit is rocked forwards and stretched as the rocker cam unit is rocked back, and a rear spring 38 which does the opposite. Thus, on each spring unit 16 the two springs 36, 38 together tend to keep the rocker cam unit at an intermediate, datum orientation, neither rocked forwards nor back, unless the chair user rocks in the chair, or operation of the handle 28 in a sense to thrust the legrest 22 is used as a means to tilt the rocker cam unit back somewhat (as is conventional) in order to shift the user's center of gravity relatively rearwards as his or her feet are elevated.

Also in the chair embodiment shown, the base 12 includes a front rail 40 which extends laterally between the side rails 32 and the side rails serve as legs by which the chair 10 is supported dn the floor. It would be possible without departing from the invention to interpose a turntable between the base 12 and the floor, or intermediate the height of the base 12 in order to constitute the chair 10 a swivel rocker. Such a modification would be accomplished by wholly conventional means and accordingly is not further illustrated.

The rocker cam unit 14 also is shown including a front rail 42 which extends laterally between the left and right cam-shaped rockers.

Each of the rails 40, 42 is shown being of generally rectangular cross-sectional figure, the rail 40 being oriented so that its flat, broad upper surface 44 is generally horizontal and the rail 42 being oriented at a positive pitch so that its flat, broad upper surface 46 is canted towards the rear and its flat, broad lower surface 48 is canted towards the front. (In the particular instance depicted, the rear half of the upper surface 46 is shown medially notched at 50 to accommodate the path of movement of part of the rocker-blocking mechanism 30.)

Figure 2:
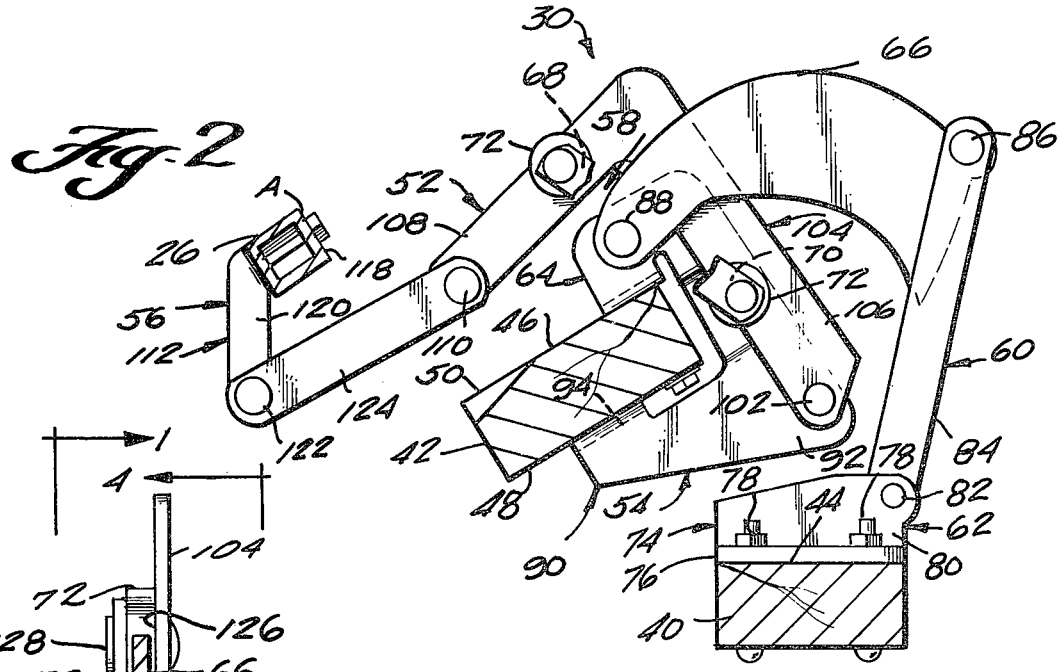
FIG. 2 is a fragmentary sectional view on a larger scale of the rocker-blocking mechanism location region outlined in chain dot line in FIG. 1. In this view the link which forms the right side of the slot is partly broken away to show how much space there is above and below the wedge element in the slot.
Figure 3:
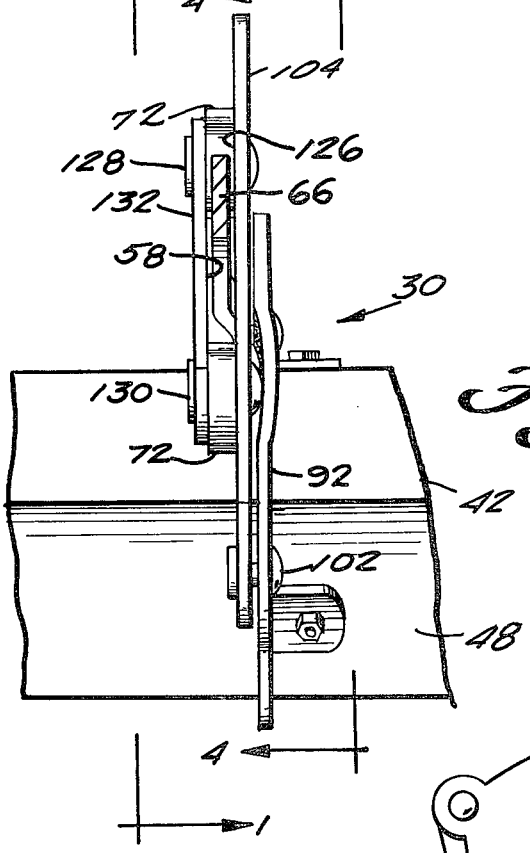
FIG. 3 is a fragmentary front elevational view of the region shown in FIG. 2, with the wedge element being shown broken away and sectioned at the entrance of the slot.
Figure 4:
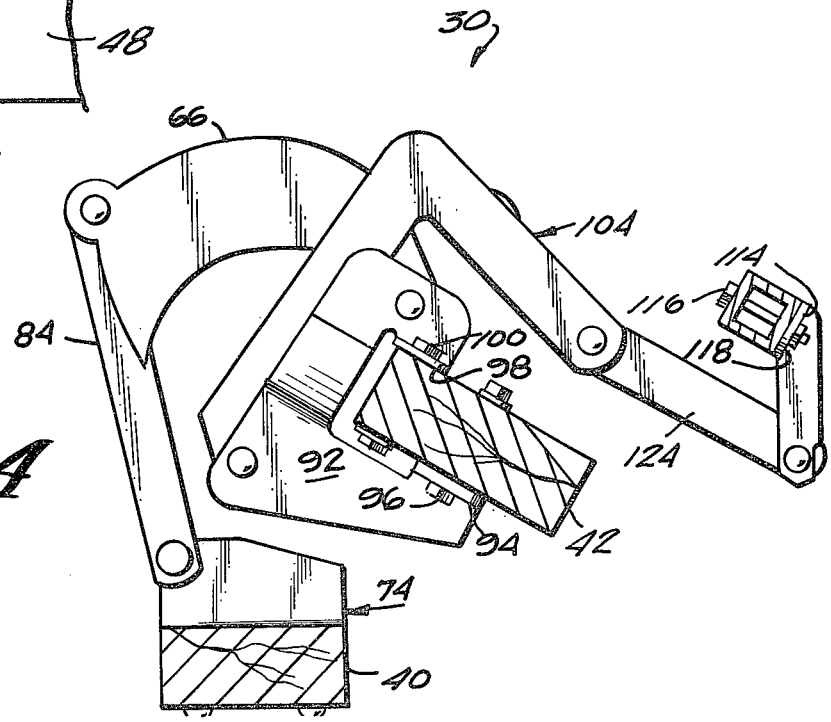
FIG. 4 is a fragmentary sectional view similar to FIG. 2, but looking in the opposite direction. This view is taken on a plane somewhat to the left of a medial plane. Its location is indicated by the line 4—4 in FIG. 3.
Figure 8:
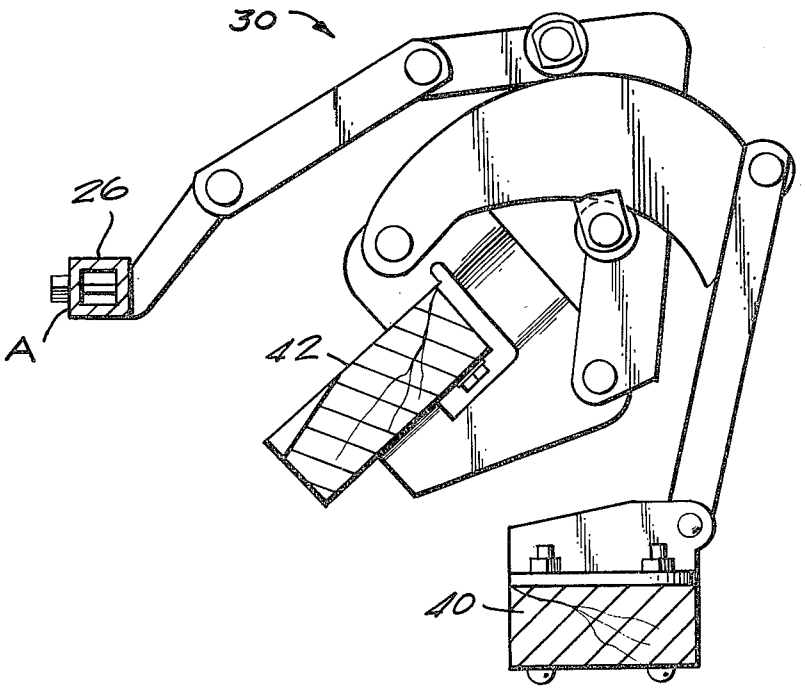
FIG. 8 is a fragmentary sectional view similar to FIG. 6, but of the status of the rocker-blocking mechanism when the legrest has been thrust and raised to its fully extended condition. Again, the link which forms the right side of the slot is partially broken away in this view in order to show that the wedge element completely fills the height of the slot.
Figure 7:
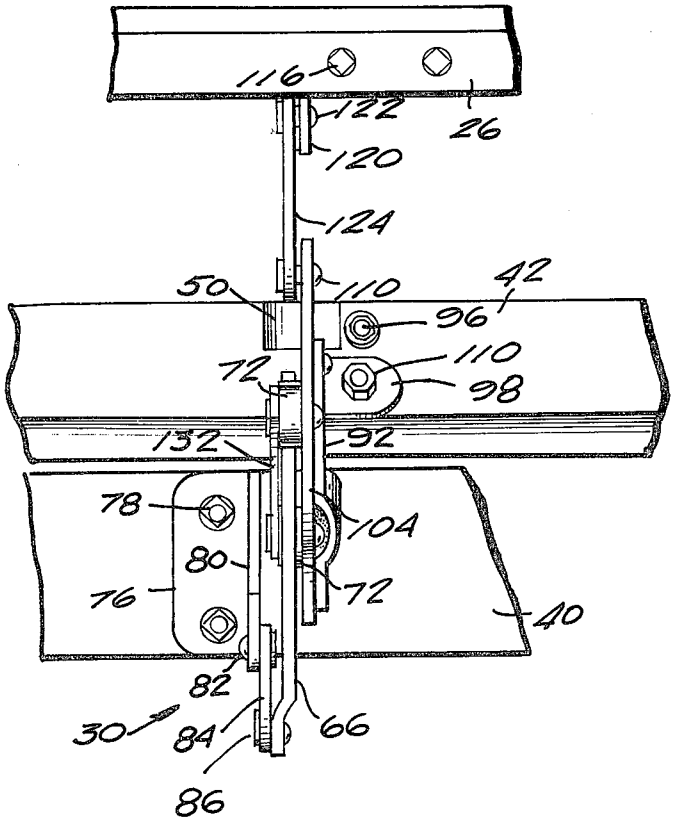
FIG. 7 is a fragmentary top plan view of the structure as shown in FIG. 6.

In FIGS. 2 and 8, one respective face of the torque bar 26 is labeled "A" so that by comparing the two views one can see how much the torque bar 26 is rotated (counterclockwise when going from FIG. to FIG. 8 to fully thrust the legrest, and clockwise when going back from FIG. 8 to FIG. 2 to fully retract the legrest) by corresponding rotary cranking of the operating handle. The total arc is through somewhat less than half a full circle in the embodiment shown.

In order for all of the chair that is supported on the rocker cams 34 to rock on the rails 32 of the base 12 the front rail 42 of the rocker cam unit 14 has got to be able to move up and down in a forwardly convex arc. The length of this arc at its greatest (as measured at the front corner of the surface 48) is not very great, typically about an inch up and an inch down from the datum position indicated in FIG. 2. But because this relative movement is an essential concommitant to rocking, rocking can be prevented by erecting a strut between these two front rails, and causing that strut to be effectively substantially rigid both on tension (to prevent rearward rocking). The apparatus of the present invention causes such a strut to be automatically erected in the act of thrusting the legrest and automatically rendered ineffective in the act of stowing the legrest.

Now the structure and function of the rocker-blocking device 30 will be described in more detail.

One way of thinking about the rocker-blocking device 30, is that it is constituted by two interwoven linkage trains.

One of these, generally designated 52 includes a first end 54 pivotally based on the front rail 42 of the rocker cam unit to the lower front of the front rail 42 and a second end 56 pivotally based on the torque bar 26. Between these two ends, the first train of links includes an upwardly-to-forwardly presented, longitudinally opening slot 58. It is not necessary for this train of links to flex at all for the chair to rock; all that does happen to this train of links as the chair is rocked, is that it moves up and down as a whole with the front rail 42.

The second linkage train of the rocker-blocking device 30, generally designated 60 includes a first end 62 pivotally based on the front rail 40 of the base 12 and a second end 64 pivotally based on the front fail 42 of the rocker cam unit on the top and toward the front of the front rail 42.

An intermediate portion of the second linkage train 60 constitutes a wedge element 66 which is pointed generally horizontally, longitudinally-medially, and decreases in top-to-bottom mean height as it extends rearwards. The wedge 66 also is generally arcuate over its length so that it may be thought of as an arch which tapers from front to rear.

The wedge 66 is laced through the slot 58. In order for the chair to be able to rock, the second linkage train has got to be able to pivotally flex at both its ends, and at an intermediate joint.

When the ledgrest is in a fully retracted condition, the second end 64 of the second linkage train 60 is located partially or almost within the slot 58, and the band of the wedge element 66 that lies within the slot 58 including all of the wedge element that is brought into the slot by rocking is both relatively centrally disposed, heightwise, in slot and much shorter than the slot is long (tall), so that the chair may be freely rocked without the wedge element 66 coming into contact with the upper/-rear end 68 of the slot 54 when the chair is rocked to its foward extreme, nor into contact with the lower/front end 70 of the slot 58 when the chair is rocked to its rearward extreme.

When the legrest begins to be thrust by rotation of the torque bar 26, the second end 56 of the first linkage train is pushed substantially forwards causing the slot rapidly to move relatively forwards along the wedge element 66 to a place where the height of the wedge element is fully equal to the length of the slot 58. In further thrusting of the legrest to full extension thereof, and/or, if the chair is a recliner and the back is reclined, this relationship is maintained; the wedge element 66 is so sized and shaped that as the slot 58 swallows an increasingly more forwardly located generally vertical band of the wedge element 66, that band continues to occupy the full length/height of the slot 58. In effect, using wrestling terms for analogy, the first linkage train, with the slot, and the second linkage train, with the wedge element, get each other in full Nelson's so that the two linkage systems become an intertwined rigid unit. This provides a relatively rigid strut between the front rail 42 of the rocker cam unit 14 at the first end 54 of the first linkage train and the second end 56 of the second linkage train, and the front rail 40 of the base 12 at the first end 62 of the second linkage train. Although this strut is substantially rigid in both tension and compression, the handle 28 may continue to be freely operated to further thrust and partially retract the legrest 22 to and from any position between the extremes indicated in FIGS. 6 and 8. The handle 28 is also free to be operated to further retract the legrest to the FIG. 2, fully retracted condition and to begin again to thrust the legrest towards its FIG. 6 position. When the legrest 22 is disposed in its fully retracted condition to a condition somewhat shy of the degree of thrust indicated in FIG. 6, there is sufficient play between the height of the wedge element 66 and the height/length of the slot 58 to permit the chair to be rocked, with the previously described strut thus deactivated.

For the embodiment shown, the rocker-blocking device 30 may be made of the same sort of punched, cut and bent steel plate and rivets, washers and fasteners as is conventional for the manufacture of motion chair mechanisms such as the mechanism 24. By preference, the ends 68, 70 of the slot 58 are constituted by e.g. outer rims of bodies, e.g. respective rollers 72 made of lubricous plastic material or the like, such as nylon, polytheylene or polypropylene or the like.

In the embodiment shown, the second linkage train includes a first end bracket 74 having a base flange 76 that is bolted at 78 onto the upper surface 44 of the front rail 40 of the base 12 generally medially of the front rail 40, and an upstanding longitudinal flange 80 which at its forward end, located just above the forward margin of the upper surface 44 provides a horizontal transverse pivot 82 constituting the aforementioned first end 62 of the second linkage train 60. The lower end of a straight, generally vertically oriented link 84 is pivotally joined to the flange 80 by the pivot 82. The upper end of the link 84 provides a horizontal, transverse pivot 86 to which the forward, taller end of the wedge element 66 is pivotally connected. The rear, shorter end of the wedge element 66 provides a horizontal, transverse pivot 88 which is located just above the forward margin of the upper surface 46 of the front rail 42.

Both the second and first linkage trains are shown including an end bracket 90. This is for convenience in manufacturing. Actually the end bracket 90 could be provided as two separate end brackets: a second end bracket for the second linkage train and a first end bracket for the first linkage train. As shown, the end bracket 90 is constituted by a generally C-shaped upright longitudinal flange 92 that is open towards the rear, and which medially encircles the forward margin of the front rail 42 of the rocker cam unit 14. The bracket 90 has a first ear 94 bent-over from the lower, rear end of the C-shaped flange 92 and bolted flatwise at 96 onto the lower surface 48 of the front rail 42, medially centrally of the front rail 42. The bracket 90 further has a second ear 98 bent-over from the upper, rear end of the C-shaped flange 92 and bolted flatwise at 100 onto the upper surface 46 of the front rail 42, medially near the forward margin of the upper surface 46. Thus the C-shaped flange 92 is rigidly mounted to the front rail 42.

The upper, rear end of the C-shaped flange 92 is pivotally joined to the rear, shorter end of the wedge element 66 to provide the aforementioned second end 64 of the second linkage train 60.

The rearwardly-facing C-shaped flange 92 is further provided with a horizontal, transverse pivot 102 which is located at the lower front thereof, i.e. to the front of and below the front edge of the lower surface 48 of the front rail 42.

Figure 6:
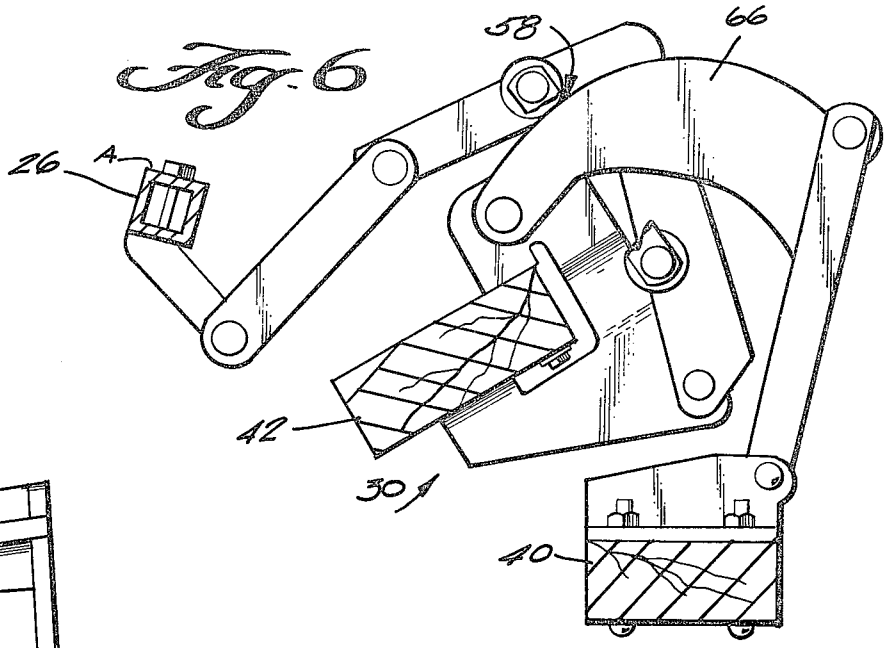
FIG. 6 is a fragmentary sectional view similar to FIG. 2, but of the status of the rocker-blocking mechanism when the chair is in the condition shown in FIG. 5. In this view the link which forms the right side of the slot is partly broken away to show how much the wedge element fills the slot.
Figure 5:
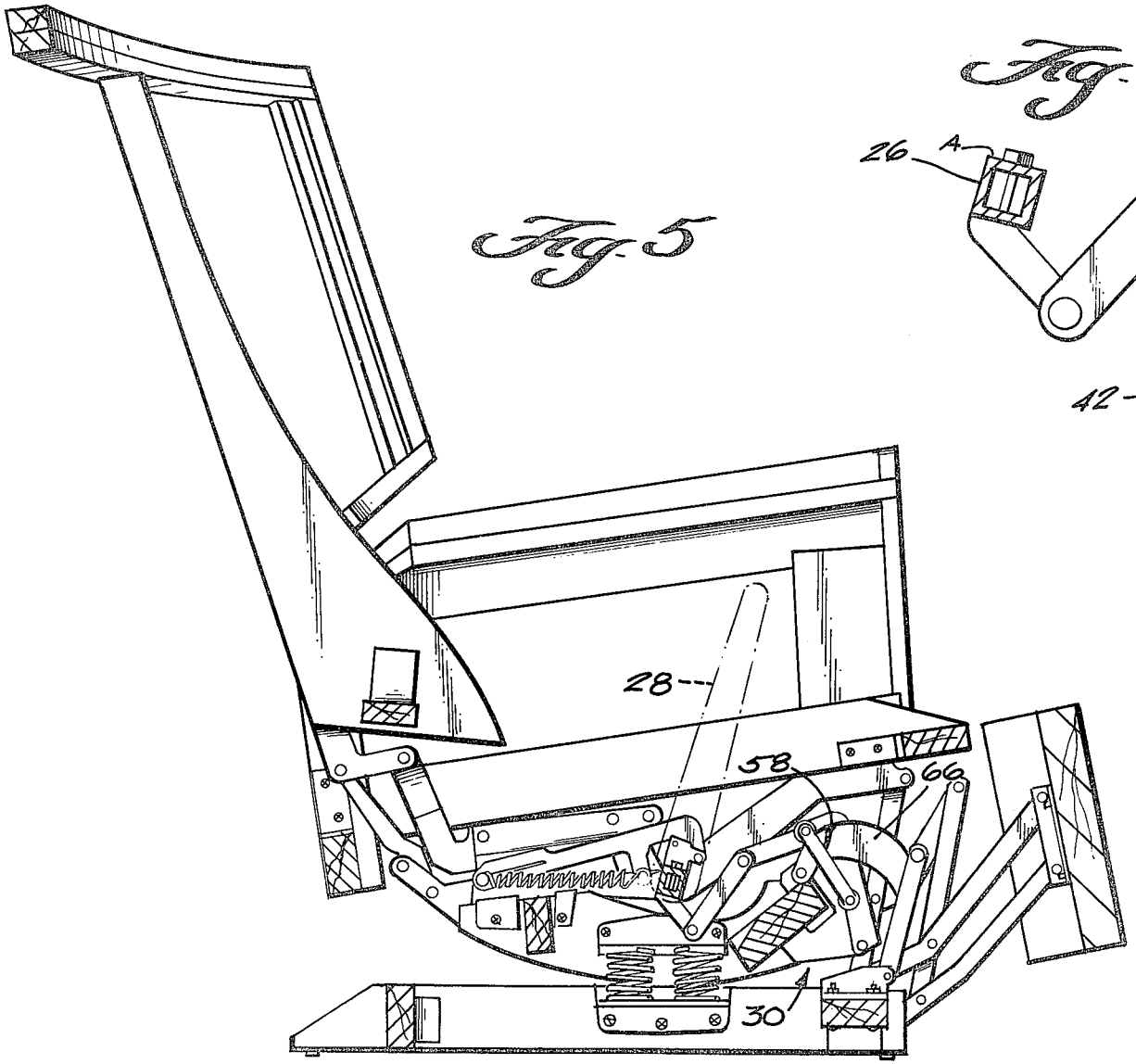
FIG. 5 is a longitudinal vertical sectional view of the chair of FIG. 1, when the legrest has been thrust sufficiently to activate the rocker-blocking mechanism.

An inverted, reversed L-shaped link, i.e. a "7" shaped bellcrank link 104 as seen in FIGS. 2, 6 and 8, has the lower end of its generally vertical leg 106 pivotally joined to the end bracket 90 by the pivot 102 to provide the aforementioned first end 54 of the first linkage train 52. The rear end of the upper, generally horizontal leg 108 of the link 104 provides a horizontal, transverse pivot 110.

The first linkage train 52, as shown, includes an end bracket 112 which has a transverse flange 114 bolted, at 116, medially to the torque bar 26, onto that face 118 of the torque bar which is disposed generally to the rear and somewhat downwards when the legrest is fully retracted (FIG. 2), which face 118 becomes disposed generally full forwards when the legrest is fully projected (FIG. 8). The end bracket 112 further includes a longitudinal flange 120 bent at generally a right angle to the plane of the transverse flange 114, but at such an angle that when the legrest is fully retracted (FIG. 2), the flange 120 points generally vertically downwards, and points upwards and somewhat forwards when the legrest is fully projected (FIG. 8).

The free end of the flange 120, i.e. the end located distally of the mounting flange 112 is provided with a horizontal, transverse pivot 122, which provides the aforementioned second end 56 of the first linkage train 52.

A straight link 124 is pivotally joined at its lower, rear end to the flange 120 by the pivot 122 and at its forward, upper end to the rear end of the upper, generally horizontal leg 108 of the "7"-shaped link 104 by the pivot 110. Accordingly, as the legrest is fully extended from a fully retracted condition and fully retracted from a fully extended condition, the straight link 124 is snaked along a generally S-shaped path at the beginning and end of which it is generally horizontally longitudinally disposed (FIGS. 2 and 8), and in the central segment of which, it becomes approximately vertically disposed (FIG. 6).

All that remains to be described is what provides the slot 58. As shown, it is provided at an intermediate level on the right side of the "7"-shaped link 104; in fact, the right side surface 126 of the link 104 is shown constituting the left side of the slot 58. The remainder of the slot 58 is shown constituted by laterally rightwardly projecting studs 128, 130 respectively based at an intermediate height on the vertical leg 106 of the link 104 and at an intermediate location on the generally horizontal, upper leg 108 of the link 104. The rollers 72 are journalled on the studs 128, 130 to provide the ends of the slot. The opposite (right) side of the slot 58 is shown provided by a straight link or plate 132 fixedly secured to the studs 128, 130 so as to be parallel to and laterally spaced from the right side surface 126 of the link 104. The main purpose of the plate 132 is to fix the right ends of the studs 128, 130 and to keep the rollers 72 in place. In practice, if the studs 128, 130 were stoutly fixed in the link 104 and had upset right ends to keep the rollers 72 in place, the plate 132 might be omitted. In the same vein, if grating, squeaking noise is not a problem, the rollers 72 could be omitted, and the studs 128, 130 made correspondingly larger or repositioned slightly to themselves constitute the ends of the slot 58. Referring to the items 72 as "rollers", may be a misnomer, since it usually would not be necessary for them to rotate at all; rather if they are sufficiently lubricous, they may be non-rotating spacer bushings mounted on the studs 128, 130 and squeezingly trapped between the link 104 and the plate 132.

It should now be apparent that the rocker-blocking device for rocking chair having projectable/retractable footrest as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For use on a motion chair, which includes:

a base having longitudinal left and right side rails and a transverse front rail;

a rocking portion including:

a rocker cam unit having left and right rockers rockably supported on said side rails, and a transverse front rail fixedly mounted relative to said rockers;

a body-supporting portion for supporting a portion of the chair-user's body;

a motion chair mechanism mounting said body supporting portion upon said rocker cam unit for movement between two positions in which the character of support offered said portion of the chair-user's body differs substantially so as to provide a sense of greater control in one of said positions so that the ability of the rocking portion to rock is desired, and so as to provide a sense of lesser control in the other of said positions so that the ability of the rocking portion to rock is not desired; and means associated with said motion chair mechanism for selectively moving said body-supporting portion to, from and between said positions of greater and lesser control by operating said motion chair mechanism, this selectively moving means including a transversally extending torque bar which is rotated about its own longitudinal axis clockwise and counterclockwise through an arc in order to operate said motion chair mechanism, a rocker-blocking device, comprising:

a first generally longitudinally extending train of pivotally connected links having one end adapted to be pivotally secured to the rocker cam unit and another end adapted to be pivotally secured to said torque bar, so that as said torque bar is rotated in the angular sense which causes said body-supporting portion to be moved to said position of greater control said first train of pivotally connected links is toggled about said torque bar and as said torque bar is rotated in the angular sense which causes said body-supporting portion to be moved to said position of lesser control said first train of pivotally connected links is de-toggled from about said torque bar;

said first train of pivotally connected links including means defining a longitudinally elongated slot having an upper/rear end and a lower/front end; and a second generally longitudinally extending train of pivotally connected links, having one end adapted to be pivotally secured to said base and another end adapted to be pivotally secured to the rocker cam unit, relative to the rear of said one end of the first train of pivotally connected links, with the first and second trains of pivotally connected links crossing past one another between their respective ends;

said second train of pivotally connected links including means defining a longitudinally elongated wedge element which has upper and lower edges which converge toward one another rearwardly of said wedge element so that said wedge element is taller toward the front of the chair and shorter toward the rear of the chair;

said wedge element being disposed through said slot means so that a variably, located, longitudinally short band of said wedge element lies within said slot means;

the dimensions and spatial orientations of said wedge element and said slot being such that when said first train of links is toggled about said torque bar by operation of said selectively moving means, the band of said wedge element which lies within said slot means is located toward the rear of the chair and is so short and so centrally disposed relative to the length of the slot, that said rocking portion of the chair is free to be rocked on said base and when said first train of links is de-toggled from about said torque bar by operation of said selectively moving means, the band of said wedge element which lies within said slot means is located toward the front of the chair and is so tall that its upper and lower edges are in contact with the upper/rear and lower/front ends of the slot means, respectively, and said first and second trains of links, together, thus, constitute a substantially rigid, longitudinally aligned strut which is active both in tension and compression between the rocker cam unit and the base to prevent rocking of the rocking portion of the chair upon the base.

2. The rocker-blocking device of claim 1, wherein:

the first train of pivotally connected links includes a pivot-providing first end bracket means constructed and arranged to be fixed to said front rail of said rocker cam unit and pivot-providing second end bracket constructed and arranged to be fixed to said torque bar; and the second train of pivotally connected links includes a pivot-providing first end bracket constructed and arranged to be fixed to said front rail of said base and a pivot-providing second end bracket means constructed and arranged to be fixed to said front rail of said rocker cam unit.

3. The rocker-blocking device of claim 2, wherein:

said first end bracket means of said first train of links and said second end bracket means of said second train of links are constituted by a shared integral bracket member.

4. The rocker-blocking device of claim 3, wherein:

said pivot provided on said integral bracket member for said first train of links is disposed to be located under said front rail of said rocker cam unit and said pivot provided on said integral bracket member for said second train of links is disposed to be located over said front rail of said rocker cam unit.

5. The rocker-blocking device of claim 4, wherein:

said wedge element near the rear thereof being pivotally connected by the respective said pivot which is disposed to be located over said front rail of said rocker cam unit, this pivot being constructed and arranged to lie rearwardly adjacent said slot means when said first train of links is toggled about said torque bar.

6. The rocker-blocking device of claim 4, wherein:

for a chair wherein the front rail of the rocker cam unit has an underside and an upper side, said integral bracket member comprises a vertical, longitudinally aligned, rearwardly opening C-shaped flange having at its lower, rear end a first bent-over ear adapted to be secured on the underside of said front rail of said rocker cam unit and at its upper, rear end a second bent-over ear adapted to be secured on the upper side of said front rail of said rocker cam unit, with said C-shaped flange looping about the forward margin of the front rail of the rocker cam unit;

said pivot provided on said integral bracket member for said first train of links being located on said C-shaped flange at the lower front of said C-shaped flange; and said pivot provided on said integral bracket member for said second train of links being located on said C-shaped flange near said second bent-over ear.

7. The rocker-blocking device of claim 2, wherein:

the first train of links includes a bellcrank link having said slot means provided thereon intermediate the ends of said bellcrank link; and said wedge element is constituted by an arcuate link where the upper and lower edges are curved about different centers to cause the described rearward tapering.

8. The rocker-blocking device of claim 2, wherein:

said pivot provided on said first end bracket means of said first train of links is disposed to be located under said front rail of said rocker cam unit and said pivot provided on said second end bracket means for said second train of links is disposed to be located over said front rail of said rocker cam unit.

9. The rocker-blocking device of claim 8, wherein:

said wedge element near the rear thereof being pivotally connected by the respective said pivot which is disposed to be located over said front rail of said rocker cam unit, this pivot being constructed and arranged to lie rearwardly adjacent said slot means when said first train of links is toggled about said torque bar.

10. The rocker-blocking device of claim 9, wherein:

the first train of links includes a bellcrank link having said slot means provided thereon intermediate the ends of said bellcrank link; and said wedge element is constituted by an arcuate link where the upper and lower edges are curved about different centers to cause the described rearward tapering.

11. The rocker blocking device of claim 10, wherein:

the ends of said slot means are constituted by rims of two respective rollers.

12. The rocker-blocking device of claim 11, wherein:

said rollers are made of lubricous plastic material.

13. The rocker-blocking device of claim 1, wherein:

the ends of said slot means are constituted by rims of two respective rollers.

14. The rocker-blocking device of claim 13, wherein:

said rollers are made of lubricous plastic material

15. A motion chair, which includes:

a base having longitudinal left and right side rails and a transverse front rail;

a rocking portion including:

a rocker cam unit having left and right rockers rockably supported on said side rails, and a transverse front rail fixedly mounted relative to said rockers;

a body-supporting portion for supporting a portion of the chair-user's body;

a motion chair mechanism mounting said body supporting portion upon said rocker cam unit for movement between two positions in which the character of support offered said portion of the chair-user's body differs substantially so as to provide a sense of greater control in one of said positions so that the ability of the rocking portion to rock is desired, and so as to provide a sense of lesser control in the other of said positions so t of the rocking portion to rock is desired, and so as to provide a sense of lesser control in the other of said positions so that the ability of the rocking portion to rock is not desired; and means associated with said motion chair mechanism for selectively moving said body-supporting portion to, from and between said positions of greater and lesser control by operating said motion chair mechanism, this selectively moving means including a transversally extending torque bar which is rotated about its own longitudinal axis clockwise and counterclockwise through an arc in order to operate said motion chair mechanism;

a rocker-blocking device, comprising:

a first generally longitudinally extending train of pivotally connected links having one end pivotally secured to the rocker cam unit and another end pivotally secured to said torque bar, so that as said torque bar is rotated in the angular sense which causes said body-supporting portion to be moved to said position of greater control said first train of pivotally connected links is toggled about said torque bar and as said torque bar is rotated in the angular sense which causes said body-supporting portion to be moved to said position of lesser control said first train of pivotally connected links is de-toggled from about said torque bar;

said first train of pivotally connected links including means defining a longitudinally elongated slot having an upper/rear end and a lower/front end; and a second generally longitudinally extending train of pivotally connected links, having one end pivotally secured to said base and another end pivotally secured to the rocker cam unit, relative to the rear of said one end of the first train of pivotally connected links, with the first and second trains of pivotally connected links crossing past one another between their respective ends;

said second train of pivotally connected links including means defining a longitudinally elongated wedge element which has upper and lower edges which converge toward one another rearwardly of said wedge element so that said wedge element is taller toward the front of the chair and shorter toward the rear of the chair;

said wedge element being disposed through said slot means so that a variably located, longitudinally short band of said wedge element lies within said slot means the dimensions and spatial orientations of said wedge element and said slot being such that when said first train of links is toggled about said torque bar by operation of said selectively moving means, the band of said wedge element which lies within said slot means is located toward the rear of the chair and is so short and so centrally disposed relative to the length of the slot, that said rocking portion of the chair is free to be rocked on said base and when said first train of links is de-toggled from about said torque bar by operation of said selectively moving means, the band of said wedge element which lies within said slot means is located toward the front of the chair and is so tall that its upper and lower edges are in contact with the upper/rear and lower/front ends of the slot means, respectively, and said first and second trains of links, together, thus constitute a substantially rigid, longitudinally aligned strut which is active both in tension and compression between the rocker cam unit and the base to prevent rocking of the rocking portion of the chair upon the base.

16. The motion chair of claim 15, wherein:

The first train of pivotally connected links includes a pivot-providing first end bracket means fixed to said front rail of said rocker cam unit and pivot-providing second end bracket fixed to said torque bar; and the second train of pivotally connected links includes a pivot-providing first end bracket fixed to said front rail of said base and a pivot-providing second end bracket means fixed to said front rail of said rocker cam unit.

17. The motion chair of claim 16, wherein:

said first end bracket means of said first train of links and said second end bracket means of said second train of links are constituted by a shared integral bracket member.

18. The motion chair of claim 17, wherein:

said pivot provided on said integral bracket member for said first train of links is located under said front rail of said rocker cam unit and said pivot provided on said integral bracket member for said second train of links is over said front rail of said rocker cam unit.

19. The motion chair of claim 18, wherein:

said wedge element near the rear thereof being pivotally connected by the respective said pivot which is located over said front rail of said rocker cam unit, this pivot lying rearwardly adjacent said slot means when said first train of links is toggled about said torque bar.

20. The motion chair of claim 18, wherein:

the front rail of the rocker cam unit has an underside and an upper side;

said integral bracket member comprises a vertical, longitudinally aligned, rearwardly opening C-shaped flange having at its lower, rear end a first bent-over ear secured on the underside of said front rail of said rocker cam unit and at its upper, rear end a second bentover ear secured on the upper side of said front rail of said rocker cam unit, with said C-shaped flange looping about the forward margin of the front rail of the rocker cam unit;

said pivot provided on said integral bracket member for said first train of links being located on said C-shaped flange at the lower front of said C-shaped flange; and said pivot provided on said integral bracket member for said second train of links being located on said C-shaped flange near said second bent-over ear.

21. The motion chair of claim 16, wherein:

the first train of links includes a bellcrank link having said slot means provided thereon intermediate the ends of said bellcrank link; and said wedge element is constituted by an arcuate link where the upper and lower edges are curved about different centers to cause the described rearward tapering.

22. The motion chair of claim 16, wherein:

said pivot provided on said first end bracket means of said first train of links is located under said front rail of said rocker cam unit and said pivot provided on said second end bracket means for said second train of links is located over said front rail of said rocker cam unit.

23. The motion chair of claim 22, wherein:

said wedge element near the rear thereof being pivotally connected by the respective said pivot which is located over said front rail of said rocker cam unit, this pivot lying rearwardly adjacent said slot means when said first train of links is toggled about said torque bar.

24. The motion chair of claim 23, wherein:

the first train of links includes a bellcrank link having said slot means provided thereon intermediate the ends of said bellcrank link; and said wedge element is constituted by an arcuate link where the upper and lower edges are curved about different centers to cause the described rearward tapering.

25. The motion chair of claim 24, wherein:

the ends of said slot means are constituted by rims of two respective rollers.

26. The motion chair of claim 25, wherein:

said rollers are made of lubricous plastic material.

27. The motion chair of claim 15, wherein:

the ends of said slot means are constituted by rims of two respective rollers.

28. The motion chair of claim 27, wherein:

said rollers are made of lubricous plastic material.

29. The motion chair of claim 16, wherein:

said rocker-blocking device is substantially medially located on said chair.

30. The motion chair of claim 16, wherein:

said body-supporting portion includes a projectable/-retractable legrest.

31. The motion chair of claim 16, wherein:

said body-supporting portion includes a reclinable/erectable back rest.

* * * * *